US010286251B2

(12) United States Patent
Watry

(10) Patent No.: US 10,286,251 B2
(45) **Date of Patent: *May 14, 2019**

(54) LOAD DISTRIBUTING GRIP HANDLE

(71) Applicant: Krissa Watry, Charleston, SC (US)

(72) Inventor: Krissa Watry, Charleston, SC (US)

(73) Assignee: Dynepic Sports LLC, Charleston, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/098,801

(22) Filed: Apr. 14, 2016

(65) Prior Publication Data

US 2017/0296860 A1 Oct. 19, 2017
US 2018/0099175 A9 Apr. 12, 2018

Related U.S. Application Data

(63) Continuation of application No. 13/803,915, filed on May 6, 2013, now Pat. No. 9,370,685.

(51) Int. Cl.
*A63B 21/00* (2006.01)
*A63B 21/16* (2006.01)
*A63B 22/00* (2006.01)

(52) U.S. Cl.
CPC ..... *A63B 21/4035* (2015.10); *A63B 21/4033* (2015.10); *A63B 21/4043* (2015.10); (Continued)

(58) Field of Classification Search
CPC ..... A63B 21/0004; A63B 21/00043; A63B 21/00058; A63B 21/00069; A63B 21/00185; A63B 21/02; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/08; A63B 21/15; A63B 21/151; A63B 21/152; A63B 21/4027; A63B 21/4033; (Continued)

(56) References Cited

U.S. PATENT DOCUMENTS 2,134,451 A * 10/1938 Mogren ..... A63B 21/06 473/457
2,716,027 A * 8/1955 Gehri ..... A63B 21/023 482/131

(Continued)

FOREIGN PATENT DOCUMENTS

DE 19928821 A1 * 1/2001 ..... A63B 21/4035

*Primary Examiner* — Gary D Urbiel Goldner
(74) *Attorney, Agent, or Firm* — Gregory Finch; Finch Paolino, LLC

(57) ABSTRACT

Grip handles for coupling to a resistance force provided by exercise equipment, resistance bands, or a user's own bodyweight. Each grip handle is defined by an increasing outer surface circumference along a length of the grip handle to form a generally conical shaped handhold attached to a rigid or flexible member, where the rigid or flexible member is coupled at an apex of the grip handle. The generally conical shaped handhold provides a comfortable and ergonomic surface to securely distribute the grip force of the user during exercise movements, thus significantly reducing pressure points and grip requirements of current exercise handles.

6 Claims, 11 Drawing Sheets

(52) U.S. Cl.
CPC ..... *A63B 21/169* (2015.10); *A63B 21/1645* (2013.01); *A63B 2022/0035* (2013.01); *A63B 2022/0041* (2013.01); *A63B 2209/00* (2013.01); *A63B 2209/14* (2013.01)

(58) Field of Classification Search
CPC ..... A63B 21/4035; A63B 21/4039; A63B 23/035; A63B 23/03508; A63B 23/03516; A63B 23/03525; A63B 23/03533; A63B 23/03541; A63B 23/12; A63B 23/1209; A63B 23/1227; A63B 23/1236; A63B 23/1245; A63B 23/1281; A63B 2209/00; A63B 2209/02; A63B 2209/023
See application file for complete search history.

(56) References Cited

U.S. PATENT DOCUMENTS 3,438,413 A 4/1969 Borah
3,517,931 A * 6/1970 Kalish ..... A63B 5/20 482/82
3,633,646 A * 1/1972 Zilver ..... E06B 9/305 160/168.1 R
3,712,343 A * 1/1973 Sparks ..... A63B 53/14 138/177
3,764,131 A * 10/1973 Rooks ..... A63B 23/14 482/46
3,843,119 A * 10/1974 Davis ..... A63B 21/154 289/1.2
3,995,650 A 12/1976 DiVito
3,999,752 A * 12/1976 Kupperman ..... A63B 21/154 273/DIG. 19
4,060,240 A * 11/1977 Dunston ..... A63B 23/0355 482/131
4,109,907 A * 8/1978 Zito ..... A63B 21/06 482/904
4,222,560 A * 9/1980 Hallerman ..... A63B 23/16 273/DIG. 4
4,339,138 A * 7/1982 Di Manno ..... A63B 65/00 473/596
4,348,774 A * 9/1982 Woodson ..... A41F 9/002 128/95.1
4,375,886 A * 3/1983 Muys ..... A63B 5/20 482/82
4,378,113 A * 3/1983 Piccini ..... A63B 15/00 473/457
4,466,309 A 8/1984 Matey
4,560,160 A * 12/1985 Smith ..... A63B 21/018 482/120
4,563,002 A * 1/1986 Jardine ..... A63B 5/20 482/82
4,784,391 A * 11/1988 Herron ..... A63B 67/10 273/109
4,867,444 A * 9/1989 Castillo ..... A63B 21/0724 482/106
4,925,181 A * 5/1990 Anderson ..... A63B 21/0084 446/153
4,941,232 A 7/1990 Decker et al.
4,974,836 A * 12/1990 Hirsch ..... A63B 21/06 473/451
5,004,228 A * 4/1991 Powers ..... A63B 23/04 482/139
5,076,570 A * 12/1991 Davis ..... A63B 23/16 482/112
5,097,566 A 3/1992 Decker et al.
5,158,517 A * 10/1992 Steggert ..... A63B 21/0628 482/20
5,305,660 A 4/1994 Hasegawa
5,341,758 A * 8/1994 Strickland ..... B63B 35/815 114/253
5,423,536 A 6/1995 Brown
5,423,730 A * 6/1995 Hirsch ..... A63B 21/06 482/904
5,551,323 A 9/1996 Beere et al.
5,692,265 A * 12/1997 Dalury ..... B25D 1/00 16/421
5,816,989 A * 10/1998 Marcum ..... A63B 21/0602 482/106
5,944,618 A * 8/1999 Cheng ..... A63B 53/10 273/DIG. 23
5,984,845 A * 11/1999 Powers ..... A63B 21/0004 482/125
6,017,279 A * 1/2000 Sumitomo ..... A63B 53/10 273/DIG. 23
6,022,299 A * 2/2000 Stewart ..... A63B 21/154 482/102
6,692,415 B1 * 2/2004 Winston ..... A63B 21/0004 482/122
6,692,416 B1 * 2/2004 Davis ..... A63B 21/4017 482/139
6,960,144 B2 11/2005 Tucker, Sr.
7,090,622 B2 * 8/2006 Hetrick ..... A63B 21/00043 482/139
7,364,555 B1 * 4/2008 Davidson ..... A61H 1/0274 482/131
7,410,451 B2 * 8/2008 Williams ..... A63B 21/4043 482/139
7,473,213 B1 * 1/2009 Kallenbach ..... A63B 21/055 16/428
7,691,040 B1 * 4/2010 Schwinghamer ..... A63B 21/00 482/106
7,740,570 B2 * 6/2010 Winston ..... A63B 5/20 482/121
7,828,703 B1 * 11/2010 Boesch ..... A63B 21/0602 482/112
7,896,783 B2 * 3/2011 Kessler ..... A63B 5/20 482/82
7,955,236 B2 * 6/2011 DiGiovanni ..... A63B 21/0552 482/124
8,113,993 B2 * 2/2012 McVan ..... A63B 21/154 482/108
8,152,704 B2 * 4/2012 Brice ..... A63B 21/00 482/129
8,192,337 B2 * 6/2012 Birch ..... A63B 21/00185 482/126
8,684,892 B1 * 4/2014 Ihli ..... A63B 5/20 482/81
8,944,964 B1 * 2/2015 Saffaie ..... A63B 23/14 482/44
9,370,685 B2 * 6/2016 Watry ..... A63B 69/0093
D782,272 S * 3/2017 Watry ..... D8/312
2002/0091046 A1 * 7/2002 Deden ..... A63B 21/151 482/122
2003/0192395 A1 10/2003 Hsu
2004/0036194 A1 * 2/2004 Chadwick ..... B32B 7/02 264/250
2004/0216550 A1 11/2004 Fallak et al.
2005/0096159 A1 * 5/2005 Houston ..... A63B 69/0024 473/513
2005/0199089 A1 9/2005 Mangano et al.
2006/0084519 A1 * 4/2006 Chang ..... A63B 49/08 473/300
2008/0040891 A1 * 2/2008 Tyler ..... A63B 21/4035 16/421
2009/0093319 A1 * 4/2009 Omidi ..... A63B 69/3632 473/219
2009/0247372 A1 * 10/2009 Borth ..... A63B 5/20 482/82
2009/0247373 A1 * 10/2009 Borth ..... A63B 5/20 482/82
2010/0212453 A1 8/2010 Rouillard
2010/0248907 A1 * 9/2010 Kessler ..... A63B 5/20 482/82
2010/0292056 A1 * 11/2010 Birch ..... A63B 21/00185 482/129
2010/0317495 A1 * 12/2010 DiGiovanni ..... A63B 21/0552 482/129
2011/0009208 A1 * 1/2011 Roger ..... A63B 53/04 473/317

(56) References Cited

U.S. PATENT DOCUMENTS

| | | | | |
|---|---|---|---|---|
| 2011/0143853 | A1* | 6/2011 | Walls | A63B 53/14 473/300 |
| 2011/0219909 | A1* | 9/2011 | Galstad | B62K 21/12 74/551.9 |
| 2011/0245050 | A1* | 10/2011 | Emick | A63B 23/03508 482/139 |
| 2011/0245051 | A1* | 10/2011 | Emick | A63B 23/03525 482/139 |
| 2013/0130825 | A1* | 5/2013 | McLoughlin | A63B 60/34 473/303 |
| 2013/0337933 | A1* | 12/2013 | Wall, Jr. | A63B 53/14 473/296 |
| 2014/0066222 | A1* | 3/2014 | Huang | A45B 9/02 473/300 |
| 2014/0116196 | A1 | 5/2014 | Rogers | |
| 2014/0165336 | A1 | 6/2014 | Guyoton | |
| 2014/0329650 | A1* | 11/2014 | Watry | A63B 69/0093 482/139 |
| 2015/0224381 | A1* | 8/2015 | Rodriguez | A63B 69/0002 473/457 |
| 2016/0067536 | A1* | 3/2016 | Carpinelli | A63B 5/20 482/82 |
| 2016/0158615 | A1* | 6/2016 | Lancaster | A63B 5/22 473/422 |
| 2017/0274957 | A1 | 9/2017 | Krause et al. | |

* cited by examiner

LOAD DISTRIBUTING GRIP HANDLE

BACKGROUND OF THE INVENTION

1. Field of Invention

The present invention relates to a hand grip designed to distribute a load across the width of the grip. More particularly, the present invention relates to a hand grip especially for use with exercise equipment, including a load distributing pull handle that may be attached to various forms of resistance.

2. Description of Prior Art

Hand grips are used with varying degrees of comfort in the operation of a variety of devices including grips for using exercise equipment, grips for uses on wakeboard ropes, tools and in construction equipment.

One type of hand grip such as the grips on an exercise machine as shown in FIG. 1 are uncomfortable. Those grips include a tricep rope with two grip stops at each end. The rope is held by a hollow tubular bracket that includes a hole which attaches to a cable pull exercise machine and the rope is passed through the tube. This design requires the user to maintain a firm grip on the rope to reduce the load incurred by the stops on the hand. During a weighted exercise, the grip stops apply load through the pinky finger and base of the palm for a tricep push-down style exercise or the index finger and thumb during a hammer curl style exercise. Since the user's grip typically cannot bear the entire load, the small surface area of the hand against the grip stop bears the load of the grip making gripping uncomfortable for the user, especially as the weight used during the exercise is increased.

Another type of hand grip includes beaded grips to combat the discomfort. Other prior art grips use airline cable instead of a braided rope and have the user grip a shaped handle in the form of a half sphere or a T-shape. However these grips require the flexible airline cable to be threaded through the user's fingers as the user grips the shape, which ultimately reduces the range of motion as the airline cable applies pressure to the inside webbing between the fingers. An additional problem with the grips shown in FIG. 1 is that the braided rope has peaks and valleys that may be helpful for the grip but catch on the hollow tube bracket as it slides through, resulting in uneven rope lengths and produces uneven weight distribution on the user's arms during the exercise.

Other grips use two cables versus a single flexion member to combat the discomfort of the grip, while still others use more conventional handles where the flexible cable is attached to both end of the handle grip and the hand is oriented in a generally perpendicular fashion to the weight cable (see, handle in FIG. 2). For example, a pulley type device or bearing surface for reduced friction is provided to try to maintain equalized resistance loading on the handle. Such grips also include a grip guard to protect the hand when a conventional handle moves in a motion other than perpendicular (see, grip guard and movement shown in FIG. 2) to the weighted cable. The later invention uses a circular track that allows the resistance cable to articulate around the handle. However, since the handle is connected at both ends, even with the grip guard or circular track to protect the hand, the grips do not center the resistance load when the exercise motion is in the direction of the weighted cable like those used in tricep push-downs, overhead tricep extension, swimmers pull, hammer curls, and the like.

Exercise devices often use a handle connected to a flexible member which is fed through a pulley. A weight attached to the other end of the flexible member or even the user's own force created by grabbing a second handle on the other end of the rope provides the rehabilitation weighted resistance. Such handles used include T-shaped handles with a rope attached to the center of the long axis of the handle to a more conventional handle where the rope attaches to both ends of the long axis.

SUMMARY OF THE INVENTION

It is an object of the present invention to provide a load distributing grip handle that may be attached to various forms of resistance.

The shortcomings of the prior art grips are addressed by the present invention, which provides in the first aspect, a uniquely shaped grip handle having many uses, especially for exercise equipment that provides a resistance force. The grip handle has an increasing outer surface circumference along the length of the handle to form a generally conical shape with a member attached to the apex of the grip handle. The cone shaped grips have a front end which is the vertex above the center of the base and a rear end at the base of the cone. The diameter of the front end 1*a* is smaller than the diameter of the rear end 1*b* forming the conical shape. Typically the diameter of the front end 1*a* is from about ¾ inch to about 1½ inches, preferably about 1 inch. The diameter of the rear end varies from the diameter of the front end in an amount that forms an angle from 10° to 35°, preferably from 15° to 30°, as shown in FIG. 7, most preferably about 20°. When the angle is below 10° the user does not receive the full benefit of the distribution of the resistance force across the user's hand thus requiring more grip strength to hold onto the grip handle. On the other hand, when the angle is greater than about 35° the grip force is unequally transferred into the fingers closest to the front end, rather than distributing over the entire hand. When used as an exercise grip the length of the cone from front end to rear end may vary somewhat but is generally from about 4 inches to about 6½ inches. This will ensure the handle works for those with smaller hands as they can grab near the front end and those with larger hands can have enough grip length to comfortably grip as well. The conical grip may be made of a soft rubber like material that may also be slightly tacky to the touch. In a preferred embodiment of the present invention a pair of the cone shaped grips is attached to an inelastic tricep cable such as a rope that extends through a pulley or bracket. The flexible member could also be, in one embodiment, an elastomeric material that provides the resistance force itself or in yet another embodiment, the flexible member is a rope or cable like material attached in some means to the resistance force.

The current invention allows for the resistance force to be maintained through the center axis of the grip handle when the user's exercise motion is in the direction of the resistance force. This is an improvement over the conventional handle shown in FIG. 2 which has a moment force transmitted to the users grip when the handle cable wraps over the grip protector. Additionally, since in this invention the grip force is distributed across a larger surface area of the user's hand compared to the prior art in FIG. 1 and the unique shape and material of the handle keeps the user's hand from sliding off the grip, the present invention provides a more ergonomic and comfortable handle that requires less grip strength thus making it a prime design for use in rehabilitation exercise devices.

Other objects, features and advantages of the present invention will become apparent from the following detailed description taken in conjunction with the accompanying drawings.

BRIEF DESCRIPTION OF THE DRAWINGS

Having described the invention in general terms, reference will now be made to the accompanying drawings, which are not necessarily drawn to scale, and wherein.

DETAILED DESCRIPTION OF THE PREFERRED EMBODIMENTS

The present invention now will be described more fully hereinafter with reference to the accompanying drawings, in which preferred embodiments of the invention are shown. This invention may however, be embodied in many different forms and should not be construed as limited to the embodiments set forth herein; rather these embodiments are provided so that this disclosure will be thorough and complete, and will fully convey the scope of the invention to those skilled in the art.

Figure 1:
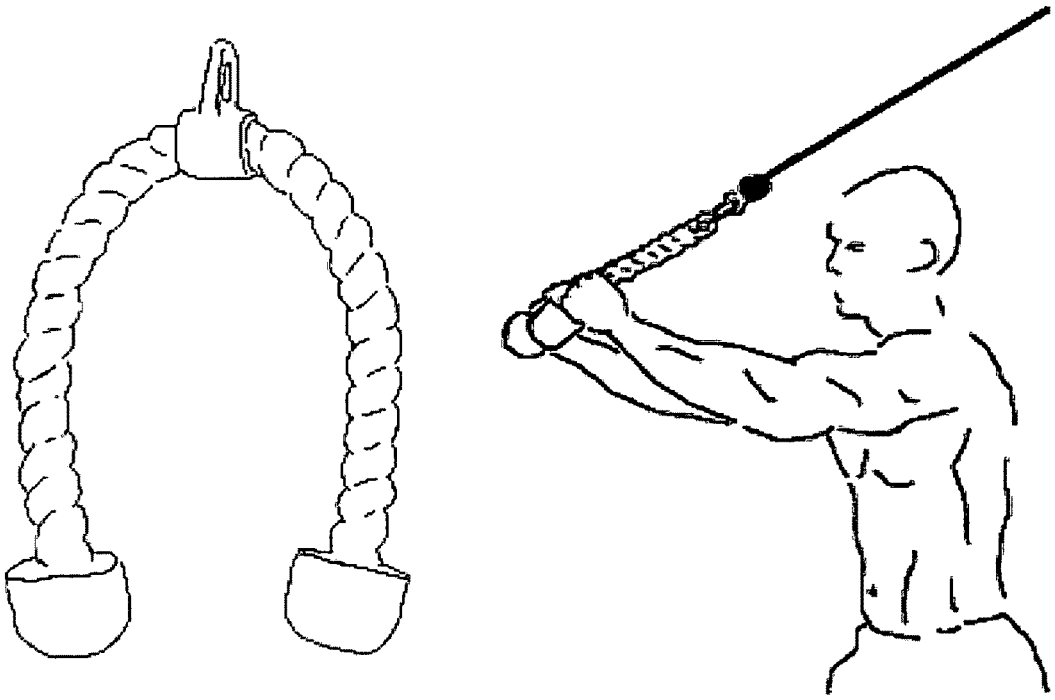
Figure 1 PRIOR ART
FIG. 1 illustrates the prior art showing a typical tricep rope exercise handle.
Figure 3:
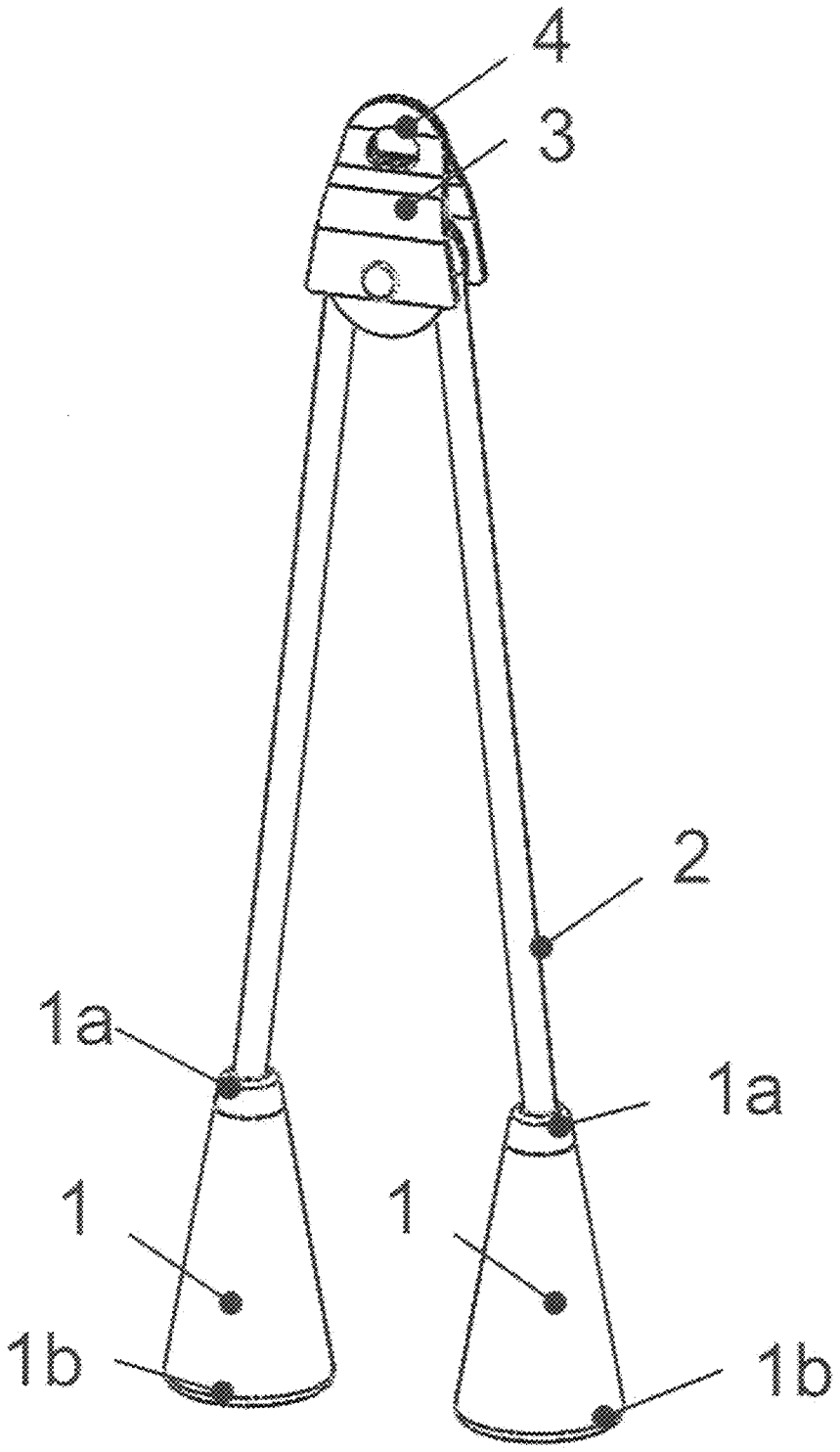
FIG. 3 is an isometric view of an embodiment of the present invention showing a pair of cone shaped grips attached to a tricep cable.
Figure 24:
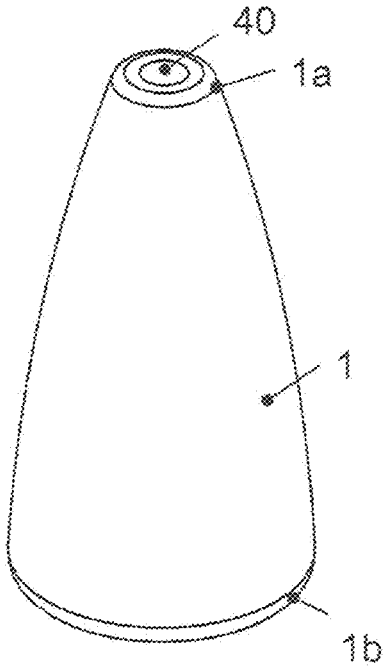
FIG. 24 illustrates a fourth embodiment of the cone grip having a slightly curved outer surface.
Figure 25:
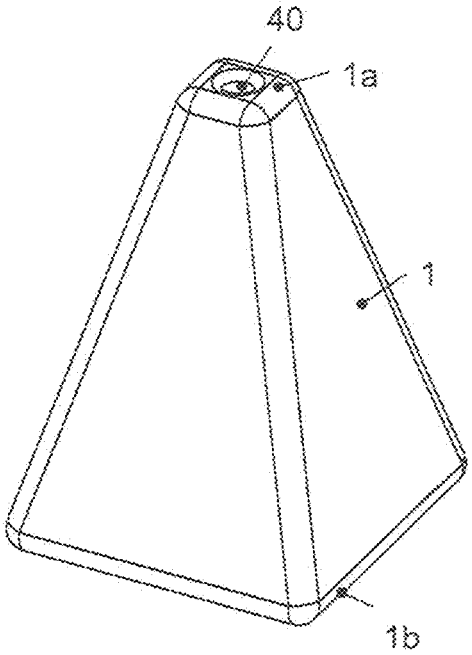
FIG. 25 illustrates a fifth embodiment of the cone grip of the present invention having combination of flat and curved surfaces.

Turning now to FIG. 3 there is shown an embodiment of the present invention depicting a pair of cone shaped grips attached to a tricep cable. In this embodiment, a pair of cone shaped grip handles 1 are attached to the ends of a member 2, such as an inelastic rope that extends through pulley 3. The pulley 3 is attached at 4 to an exercise machine. The pulley 3 in other embodiments may be a bearing surface, a bracket, or a hollow tubular structure similar to the design shown in FIG. 1 which allows the member 2 to pass through it. The cone shaped grips 1 have a front end 1*a* which is the vertex above the center of the base and a rear end 1*b* at the base of the cone. The diameter of the front end 1*a* is smaller than the diameter of the rear end forming the generally conical shape. Typically the diameter of the front end 1*a* is from about ¾ inch to about 1½ inches, preferably about 1 inch. Additionally, the cone shaped grip 1 may be a slightly curved outer grip surface as shown in FIG. 24, a combination of flat and curved sides as shown in FIG. 25, or of other designs with similarly increasing circumferences over the length of the handle. When used as an exercise grip the length of the handle from front end 1*a* to rear end 1*b* may vary somewhat but is generally from about 4 inches to about 6½ inches, preferably 5½ inches. This will ensure the handle works for those with smaller hands as they grab near the front end and those with larger hands to have enough grip length to comfortably grip as well.

Figure 2:
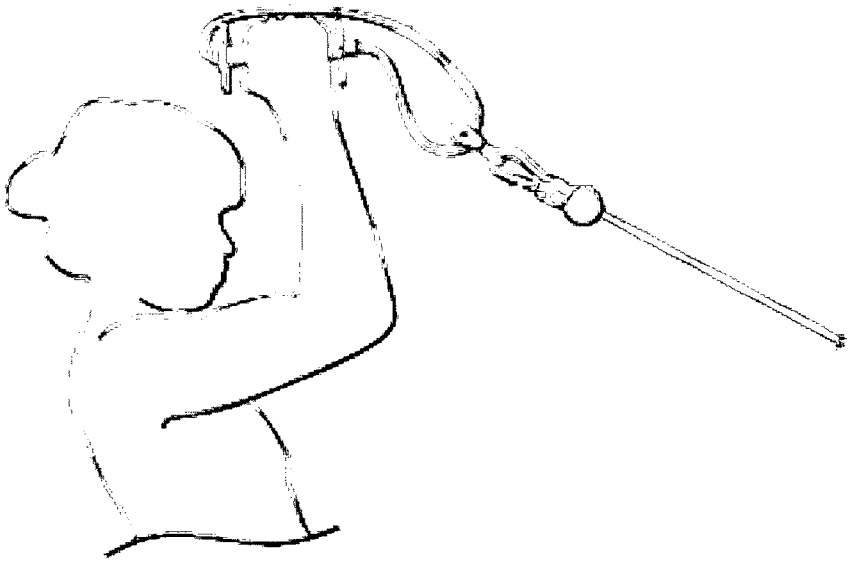
Figure 2 PRIOR ART
FIG. 2 illustrates prior art showing a conventional handle, with pulley and grip guard and additionally depicts a user performing an exercise motion in the direction of the resistance cable with this handle type.

The present invention allows for the resistance force to be maintained through the center axis of the grip handle when the user's exercise motion is in the direction of the resistance force. This is an improvement over a conventional handle such as the one shown in FIG. 2 which has a moment force transmitted to the users grip when the handle cable wraps over the grip protector. Additionally, since in this invention the grip force is distributed across a larger surface area of the user's hand compared to the handle grip shown in FIG. 1 and the unique shape and material of the handle keeps the users hand from sliding off the grip, the present invention provides a more ergonomic and comfortable handle that requires less grip strength thus making it a prime design for use in rehabilitation exercise devices.

Figure 4:
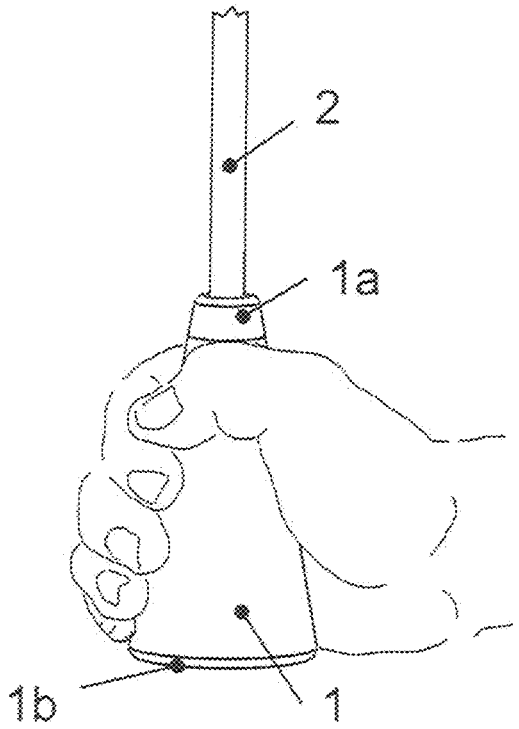
FIG. 4 is a depiction of a user's hand on the cone shaped grip of the present invention when performing a tricep push down or similar exercise.
Figure 5:
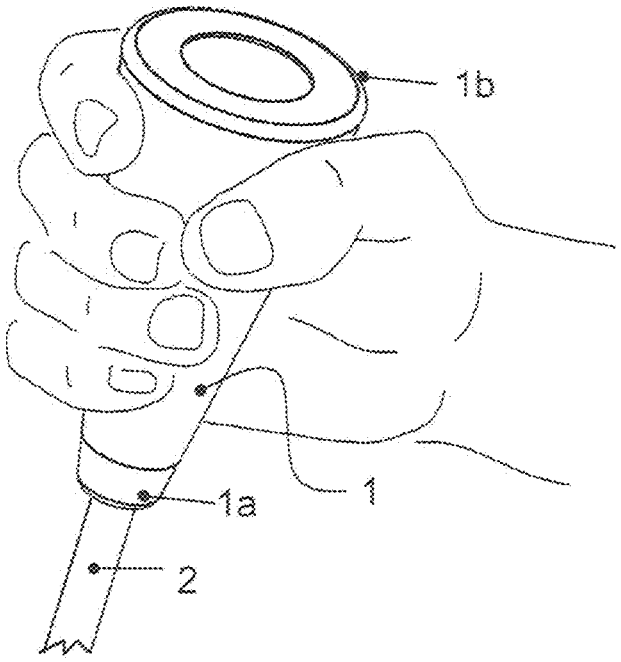
FIG. 5 is a depiction of a user's hand on the cone shaped grip of the present invention when performing a hammer curl or similar exercise.

When the grips of the present invention are used with exercise equipment the grip may be used in different ways. For example, as shown in FIG. 4 the user's hands grasp the cone shaped grip handles 1 with the thumb at the front end 1*a* when performing a tricep push down or similar exercise. On the other hand, when performing a hammer curl or similar exercise the user's thumb is positioned at the rear end 1*b*, as shown in FIG. 5.

Figure 8:
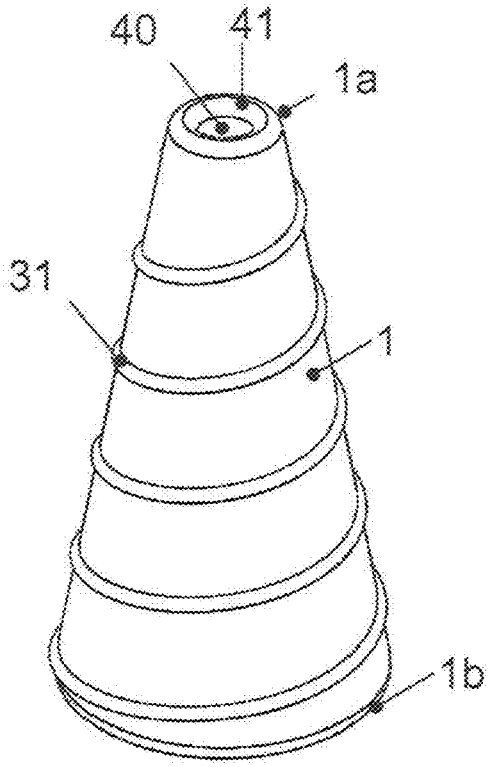
FIG. 8 is a third embodiment of the grip of the present invention.

In the embodiment heretofore described the outside of the cone of the handle grips has a smooth soft surface. In another embodiment of the present invention, that shown in FIG. 6, there is shown a second embodiment of the cone-shaped handle grip of the present invention. The grip 1, as shown has a spiral indention winding 30 from the rear end to the top end. The indention is of such width and depth as to provide for a more comfortable, easier to grasp grip. In FIG. 8 there is shown a third embodiment of the grip of the present invention wherein there is a spiral protrusion 31 extending from the rear end to the front end of the grip 1. The protrusion is of such width and height as to provide for a more comfortable grip.

Figure 6:
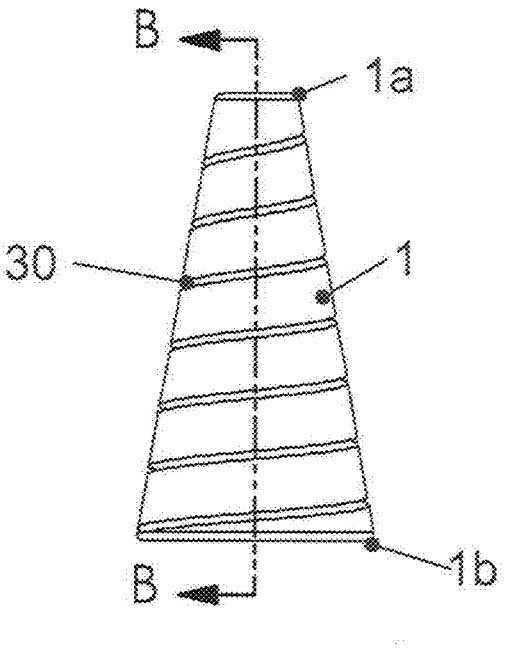
FIG. 6 is a second embodiment of the grip of the present invention.
Figure 7:
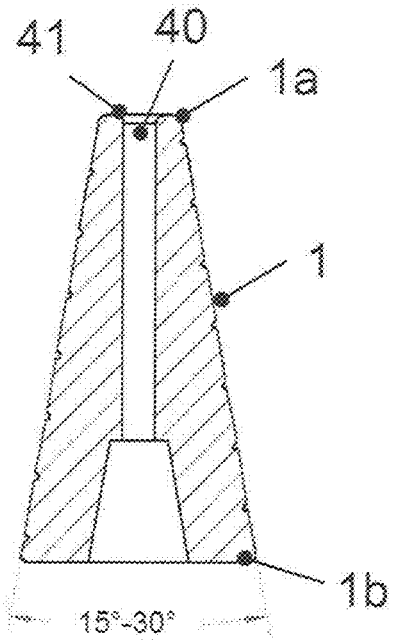
FIG. 7 is a cross section of the grip of FIG. 6 taken along line B-B.
Figure 9:
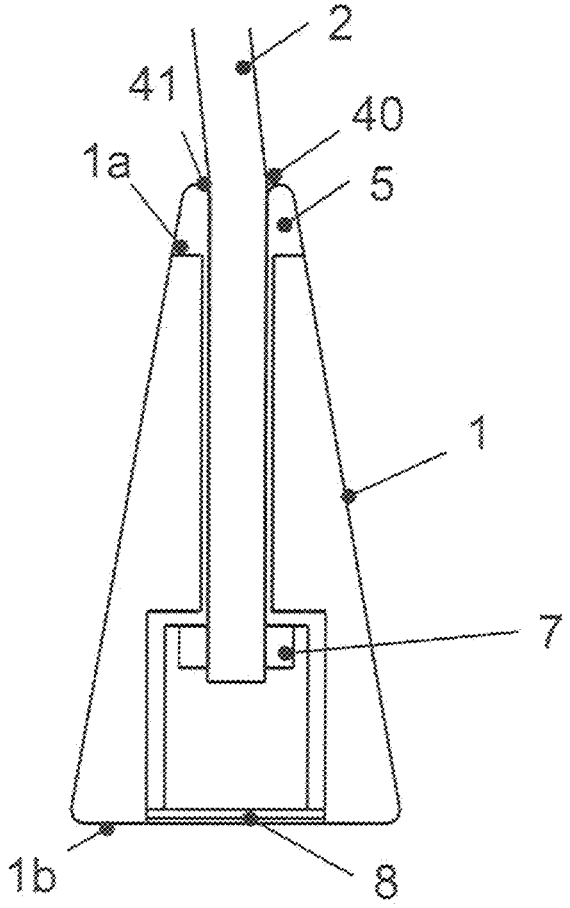
FIG. 9 is a cross-section view of the grip of the present invention showing one method to attach flexible member.

FIG. 7 is a cross section of the conical grip 1 of FIG. 6 taken along line B-B. The diameter of the rear end 1*b* varies from the diameter of the front end 1*a* in an amount that forms an angle of from 10° to 35°, preferably from 15° to 30°, as shown in FIG. 7, most preferably about 20°. When the angle is below 10° the user does not receive full benefit of the distribution of the resistance force across the user's hand and an increased grip force is required to keep the hand from slipping off the grip. On the other hand, when the angle is greater than about 35° most of the gripping force is transferred into the fingers closest to the front end, rather than distributing over the entire hand. The conical grip may be made of a soft rubber like material, for example, a visco-elastic, urethane or closed cell foam material. When the grip does not include an inner housing 5 (as shown in FIG. 9) a somewhat harder material such as a thermal plastic elastomer is used for the grip to maintain the handle shape and not noticeably deform under load. While it is conceived that a wide range of materials with varying hardness could be used for this grip, it is preferable that such material have a hardness in the range of Shore 30 A-80 A. When the grip does include an inner housing 5 the grip material may be somewhat softer in the hardness range of Shore 20-00 to Shore 80 A.

As shown in FIG. 7, a hole 40 extends through the center of grip 1 from the front end to the base or rear end. FIG. 9 is a cross-section view of the grip illustrating how a member 2 may be attached to the conical grip 1. In this embodiment, the member 2, whether it be a rigid member or a flexible member, is inserted through the hole 40 at the front end 1*a* and towards the rear end 1*b* where it is attached to a stop 7. The stop 7 may also be a knot (flexible member embodiment), a flared end (rigid member embodiment), threaded nut (rigid member embodiment), or other design. In one embodiment the conical grip includes an inner housing 5 extending from the front end 1*a* through and lining the hole 40 to an enlarged section at the rear end 1*b* of conical grip 1. The inner housing 5 may be a hard material to maintain the shape of the grip under a load, such as aluminum or plastic. The inner housing 5 may also have other mold line shapes in which the softer material is over molded or attached to form the cone shaped grip 1. The stop 7 fits into the enlarged section making a neat arrangement that does not compromise the grip 1 yet is readily detachable. It may also be desirable to include a grip handle plug 8 to provide a smooth rear end 1*b*.

In one preferred embodiment, conical grip 1 is constructed with a single material forming the grip and including hole 40 and enlarged rear end 1*b* as shown in FIG. 7 where the rubber-like material is sufficiently ductile and strong such that it will give slightly at the front end 1*a* under off-axis load without tearing during high cyclic loading. This ensures that when used for exercise motion in a slightly off-axis direction as experienced during the bottom of a tricep push down when a user flares their wrists for better tricep contraction, a moment force is not created on the user's grip. It should be understood that a softer material may be over molded on the rubber-like material as the spiral protrusion 31 or other grip aid design. Additionally, the outer surface may have a slightly tacky feel to aid in the user's grip.

One important feature of the present invention is the increasing circumference over the length of the grip which provides the improved grip. FIG. 24 and FIG. 25 illustrate other embodiments of the present invention. The grip 1 shown in FIG. 24 is a conical grip with a slightly curved outer surface. The grip 1 in FIG. 25 depicts a generally conical shape with a combination of flat and rounded sides. It should be understood that many other outer surface variations and grip material combinations are part of the present invention.

Figure 23:
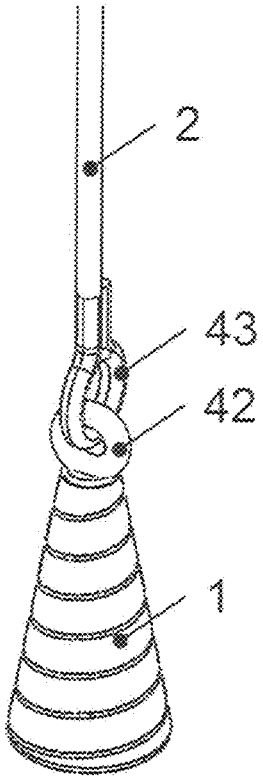
FIG. 23 illustrates other flexible member attachment methods used with the conical grip of the present invention.

The manner in which member 2 is coupled to grip 1, when member 2 is a flexible member, is an important feature of the present invention. In a preferred embodiment, the member 2 has unconstrained rotational freedom by using a flexible material, such as a rope, and securing the rope inside the body of grip 1. The member easily rotates in all three axes. In addition, the front end 1*a* of the grip includes a fillet 41 (FIG. 9) where the member 2 enters hole 40. The fillet 41 ensures reduced wear on the rope during off-axis motion. Other methods of coupling a flexible member 2 to the grip 1, while such methods may not provide the most ideal rotational freedom include, as shown in FIG. 23, an eyebolt 42 separately attached or integrally molded into the front end 1*a* of grip 1. The member 2 is then attached to the eyebolt 42 loop with a rope stitched loop 43. Further embodiments for coupling member 2 to the grip 1 include but are not limited to a swivel hook, ball and cup joint and spherical bearing. Like the flexible member embodiment, it should be understood that when member 2 is rigid, member 2 can be attached in many similar fashions internal to the grip 1 or at the front end 1*a*.

Figure 10:
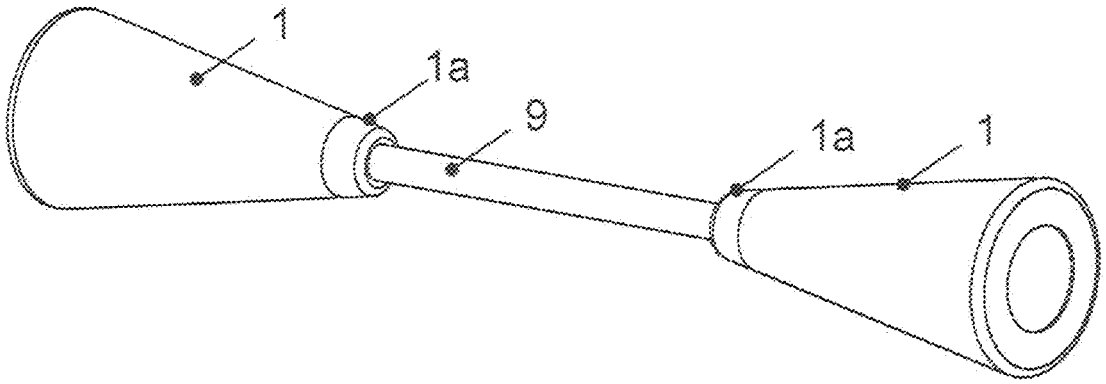
FIG. 10 is an isometric view of the grip of the present invention showing a two handled short resistance band embodiment.
Figure 11:
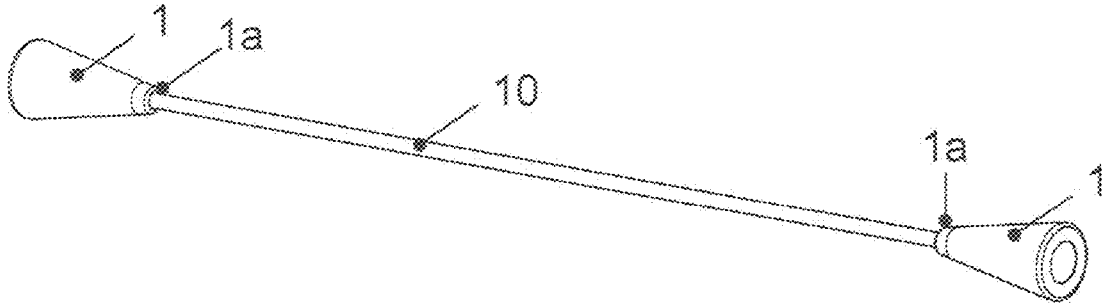
FIG. 11 is an isometric view of the grip of the present invention showing a two handled long resistance band embodiment.

Having described the conical grip handle, the following figures show the conical grip handle as it may be actually used. For example, there is shown in FIG. 10 an embodiment of an exercise device wherein two grips 1 are connected at their front ends 1*a* by a short resistance band 9. The user simply grasps both grips 1 and stretches the resistance band 9 for a predetermined regimen. The exercise device shown in FIG. 11 is similar to the one shown in FIG. 10 except that the short resistance band has been replaced by long resistance band 10. This embodiment enables the user to perform a different exercise regimen. If desired the grips may be removed from the short resistance band shown in FIG. 10 and affixed to the long resistance band 10 of the device of FIG. 11.

Figure 12:
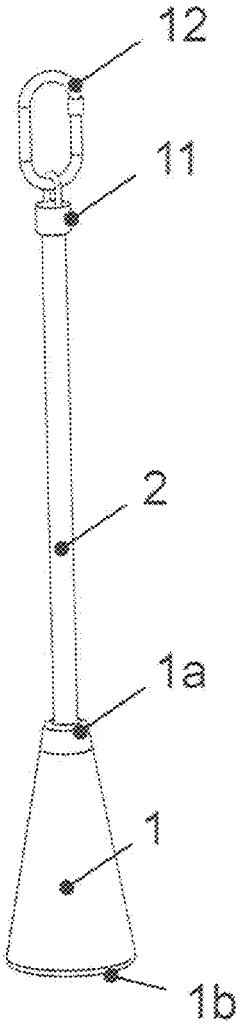
FIG. 12 is an isometric view of the grip of the present invention showing a single handle embodiment having a fixed loop for attachment to another piece of equipment.

The exercise device shown in FIG. 12 is an embodiment of a single handle conical grip 1 attached to one end of member 2 and at the other end a flexible member hook 11 is attached. In other embodiments, the flexible member hook 11 may be a rope eye splice or other similar design. As will be seen more clearly in FIG. 13 and FIG. 14 the flexible member hook 11 may be attached to spring hook 12 which is connected to a further portion of the exercise machine.

Figure 13:
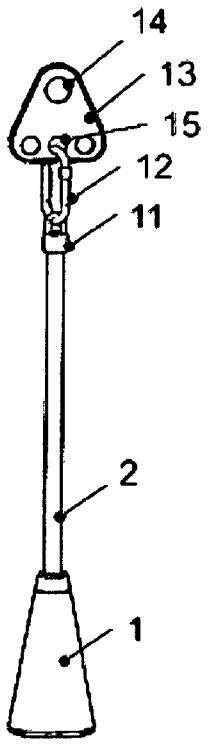
FIG. 13 is an isometric view of a grip of the present invention show a single handle version of the embodiments shown in FIG. 3 and FIG. 12.
Figure 14:
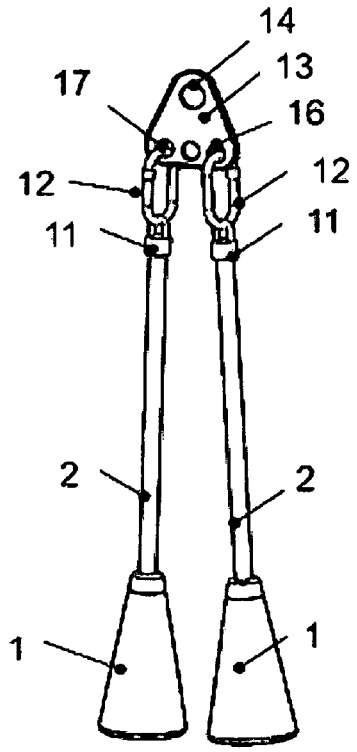
FIG. 14 is an isometric view of another embodiment of the grip of the present invention shown in FIG. 3 and FIG. 13 using two, single handle configurations.

FIG. 13 and FIG. 14, respectively, illustrate a single handle version and a double handle version of the conical grip described in FIG. 12 attached to an exercise device. In each figure spring hook 12 is attached to rigging plate 13. Rigging plate 13, in this embodiment, is more or less triangular shaped. At one point of the triangle there is an exercise machine attachment hole 14. At the other points of the triangle are attachment holes 16, 17 for the two handled version shown in FIG. 14 and a single handle attachment hole 15 located between the attachment holes 16, 17 for attachment of the shingle handle grip shown in FIG. 13.

Figure 15:
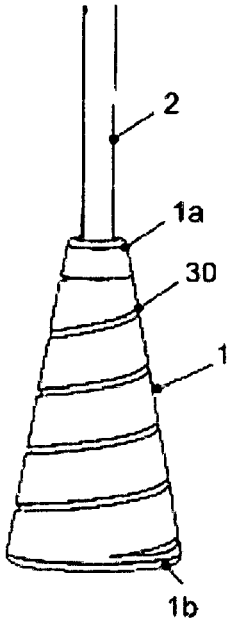
FIG. 15 is an isometric view of the embodiment of the grip design shown in FIG. 6 attached to a rod.

The conical grip handle embodiment of FIG. 6 is shown in FIG. 15 wherein grip 1 having a spiral indention winding 30 from the rear end 1*b* to the top end 1*a* is attached to member 2. The member 2 may be rigid or flexible.

Figure 16:
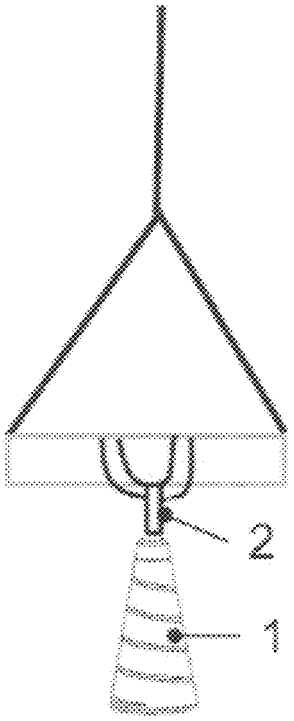
FIG. 16 illustrates a threaded loop embodiment of the grip according to the present invention attached to the handle bar of a piece of exercise equipment.
Figure 17:
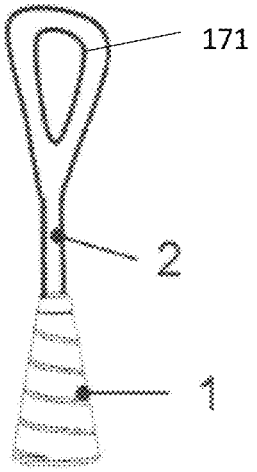
FIG. 17 illustrates a threaded loop embodiment of the conical grip according to the present invention for attachment to exercise equipment handles.

It sometimes happens that it would be desirable to attach the conical grip handle of the present invention to a bar-like handle of an exercise equipment. In such case FIG. 17 illustrates a conical grip 1 according to the present invention affixed to a flexible member 2 and having a loop 171 at the other end of the flexible member. As shown in FIG. 16 the conical grip 1 may be threaded around the bar handle of a piece of exercise equipment.

Figure 18:
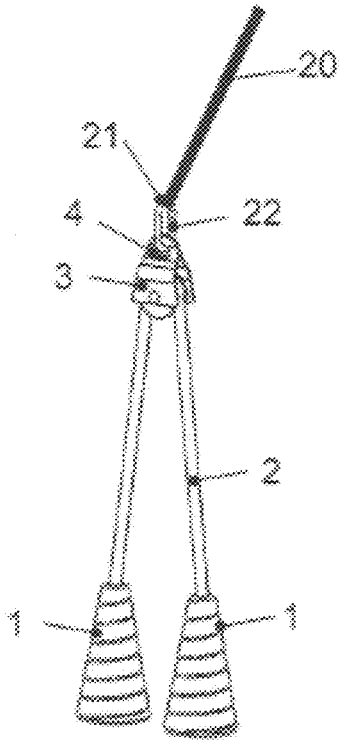
FIG. 18 illustrates a modular grip according to the present invention for use as part of a piece of exercise equipment as it might appear when attached to a member connected to an anchor.

FIG. 18 illustrates another embodiment of the use of the conical grip according to the present invention. This embodiment allows the present invention to be used as a suspension trainer. In FIG. 18, there is shown a pair of conical grips 1 such as the grips shown in FIG. 3 attached to a tricep cable 2 that extends through a pulley 3. The pulley 3 is attached to quick link 22 by hole 4 which is attached to D-ring or webbing loop 21 and then attached to inelastic cord 20 which is anchored in some fashion to a door, wall or other object.

As mentioned, there are other uses for the grip of this invention. For example, when wakeboarding, lake surfing and snowboarding riders have their body/feet oriented primarily perpendicular to their direction of motion of their board. When being towed by a boat or up the mountain with a conventional handle, the rider has to twist their upper body unnaturally relative to the board to hold a conventional handle with both hands. The cone grips allow the rider to maintain a more natural and stable position where the shoulders are generally maintained squarely over the rider's stance, in one embodiment, the handle can be thrown by or to a skier to help tow a snowboarder out of a slow snow portion. In another embodiment, the grip could be used as a snow sport tow rope grip to pull a rider up the mountain. In yet another embodiment, it is a wakeboard/lake surfing handle that allows the rider to maintain a more natural position on the board while being towed. Additionally, it may be easier to get out of the water since the rider no longer has to transition the board 90° as they are pulled out of the water and onto the board.

Figure 19:
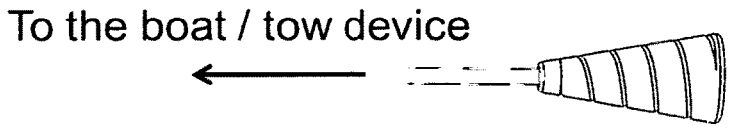
FIG. 19 illustrates the use of a single handle grip of the present invention as it might be used as a tow device connected to a boat.
Figure 20:
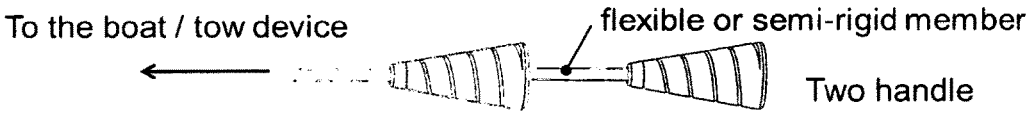
FIG. 20 illustrates the use of a two handle grip of the present invention as it might be used connected through a flexible or semi-rigid member as a tow device connected to a boat.
Figure 21:
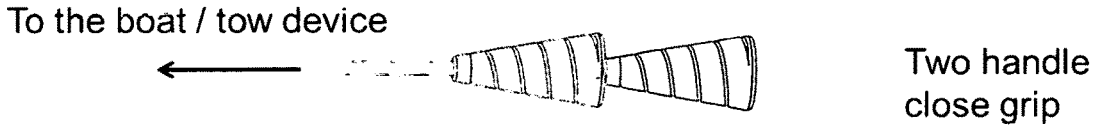
FIG. 21 illustrates the use of a two handle close grip of the present invention as it might be used as a tow device connected to a boat.

Use of a single handle grip as it might be used as a tow device connected to a boat or cable tow system is shown in FIG. 19. A companion use is shown in FIG. 20 which illustrates the use of a two handle grip as it might be used connected through a flexible or semi-rigid member as a towing device connected to a boat. In this embodiment, each grip is connected to a single tow rope and the grips are spaced adjustably apart from each other. However, sometimes the wakeboarder wants to have his/her hands close together. This embodiment is shown in FIG. 21 which illustrates the use of a two handle close grip of the present invention as it might be used as a tow device connected to a boat.

Figure 22:
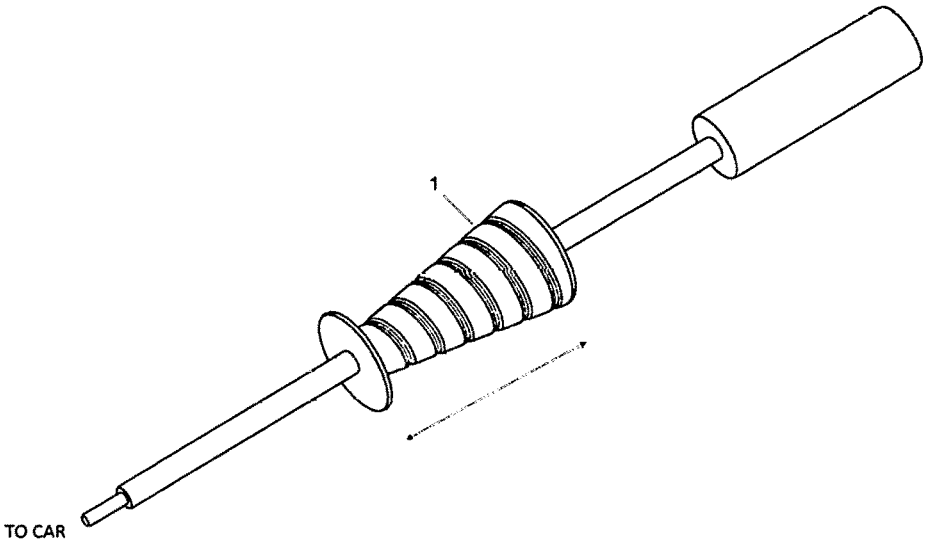
FIG. 22 illustrates the use of the grip of the present invention as it might be used as a handle for a tool.

The invention in its broadest sense may be the use of the grip of the present invention as a handle for a tool. FIG. 22 shows how the grip handle 1 might be substituted for a conventionally used handle used on a dent removal tool.

Figure 26:
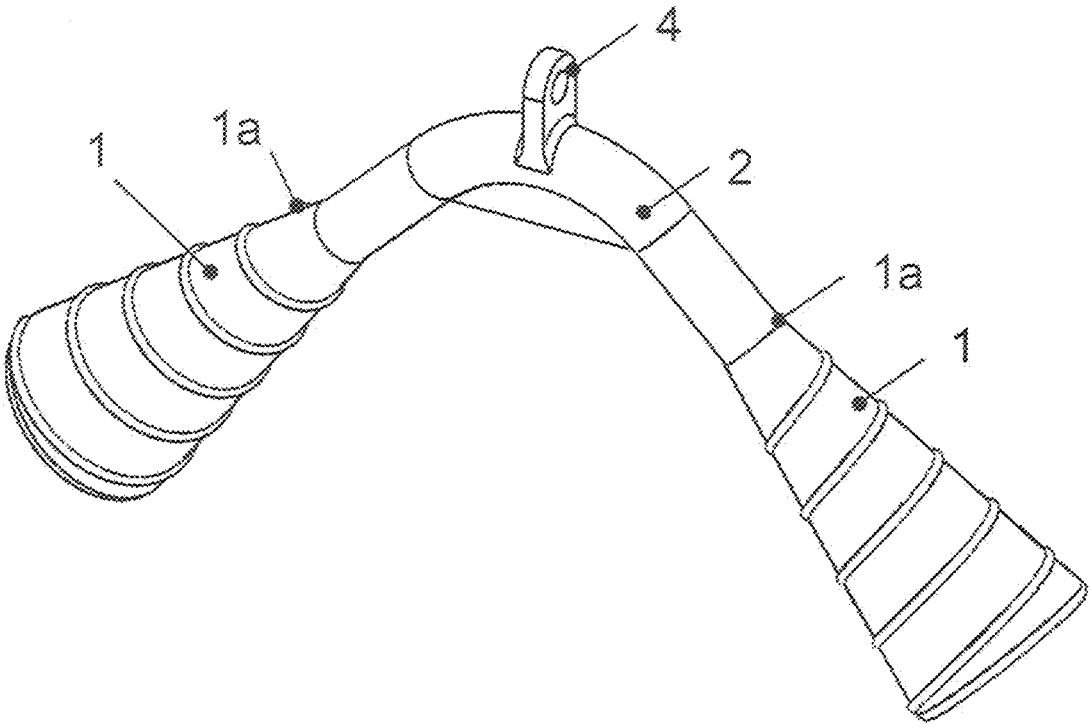
FIG. 26 illustrates a rigid member embodiment of the present invention as it may be used in a two handle tricep exercise handle.

Rigid members can also be used with the present invention for exercise handles. One embodiment of this is shown in FIG. 26 where two cone shaped grips 1 are coupled at their respective front ends 1*a* to each end of member 2, where member 2 is made of a rigid material. The handle is attached at 4 to the exercise machine.

Figure 27:
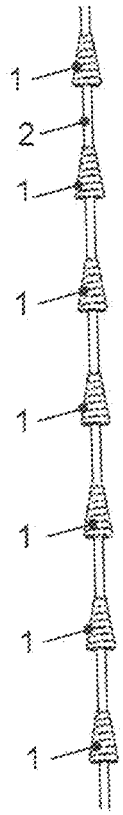
FIG. 27 illustrates the use of the grip of the present invention as it might be used on a climbing rope.

The grip of this invention may also be used on a climbing rope. FIG. 27 shows a climbing rope where the user can use the cone shaped grips to aid in climbing the rope. As shown, the rope may have a plurality of cone shaped grips 1 fixed along the length of the member 2, a climbing rope. Another embodiment may include two grip handles that may be moveably coupled to the climbing rope where the grips have a rope pinching mechanism internal to them that engages the rope under load and prevents the grip 1 from sliding down the rope, similar to a prusik. This device allows the user to transverse a bare rope such that a user may lift upward or press a release on the grip 1 that would disengage the lock mechanism on the rope and allow the user to continue up or down the rope.

Many modifications and other embodiments of the inventions set forth herein will come to mind to one skilled in the art to which these inventions pertain having the benefit of the teachings present in the foregoing descriptions. Therefore, it is to be understood that the inventions are not to be limited to the specific embodiments disclosed and that modifications and other embodiments are intended to be included within the scope of the appended claims. Although specific terms are employed herein, they are used in a generic descriptive sense only and not for purposes of limitation.

What is claimed is:

1. A grip handle for weightlifting equipment, the grip handle consisting essentially of:

two grips, each grip in the two grips having a front end, a rear end, and an elongated aperture extending through a central portion of each grip in the two grips from the front end to the rear end, each grip in the two grips being conical in shape and having a cone angle of from 10 degrees to 35 degrees, the front end having a diameter in the range of 0.75 inches to 1.5 inches, each grip in the two grips being made of a rubber of Shore hardness 30A to 80A or a thermal plastic elastomer of Shore hardness 30A to 80A;

a rigid member being bent at a midpoint between a first end and a second end of the rigid member, a first longitudinal axis extending along the rigid member to the first end, a second longitudinal axis extending along the rigid member to the second end, a first grip in the two grips being coupled to the first end of the rigid member at the front end of the first grip, and a second grip in the two grips being coupled to the second end of the rigid member at the front end of the second grip; and, a weightlifting equipment attachment means coupled to and extending along a third longitudinal axis away from a single side of the midpoint of the rigid member;

wherein the first, second, and third longitudinal axes are each oriented along different directions.

2. A grip handle for exercise equipment, the grip handle consisting essentially of:

a single grip having a front end, a rear end, and an elongated aperture extending through a central portion of the single grip from the front end to the rear end, the single grip being conical in shape and having a cone angle of from 10 degrees to 35 degrees, the front end having a diameter in the range of 0.75 inches to 1.5 inches, the single grip being made of a rubber of Shore hardness 30 A to 80 A or a thermal plastic elastomer of Shore hardness 30 A to 80 A; and a flexible member having a first end and a second end, the second end of the flexible member being a loop, the flexible member extending through the elongated aperture of the single grip at the first end of the flexible member.

3. The grip handle according to claim 2 wherein the flexible member comprises a resistance band.

4. The grip handle according to claim 2 wherein the loop of the second end of the flexible member is configured to be selectively coupled to a bar-shaped handle of an exercise equipment.

5. The grip handle according to claim 2 wherein the flexible member comprises a rope.

6. The grip handle according to claim 4 wherein the flexible member comprises a rope.

* * * * *